US005377807A

United States Patent [19]

Kojima et al.

[11] Patent Number: 5,377,807

[45] Date of Patent: Jan. 3, 1995

[54] COIN VALIDATOR WITH OPTICAL COUPLING

[75] Inventors: Takayuki Kojima, Kawagoe; Michihiro Ota, Sakado; Osamu Kobayashi, Tsurugashima, all of Japan

[73] Assignee: Nippon Conlux Co., Ltd., Tokyo, Japan

[21] Appl. No.: 175,099

[22] Filed: Dec. 29, 1993

[30] Foreign Application Priority Data

Dec. 30, 1992 [JP] Japan ..... 4-359999

[51] Int. Cl.[6] ..... G07F 3/00

[52] U.S. Cl. ..... 194/215; 359/159

[58] Field of Search ..... 194/215, 216, 217, 218, 194/317, 318, 319, 334, 335, 350; 359/154, 159

[56] References Cited

U.S. PATENT DOCUMENTS

| | | | |
|---|---|---|---|
| 4,084,677 | 4/1978 | Searle et al. | 194/318 |
| 4,374,557 | 2/1983 | Sugimoto et al. | 194/318 X |
| 4,376,478 | 3/1983 | Sugimoto et al. | 194/218 |
| 4,792,995 | 12/1988 | Harding | 359/159 X |
| 4,845,484 | 7/1989 | Ellsberg | 340/825.35 |
| 4,903,340 | 2/1990 | Sorensen | 359/159 |
| 5,048,663 | 9/1991 | Abe | 194/317 |

FOREIGN PATENT DOCUMENTS

| | | | |
|---|---|---|---|
| 3727927 | 3/1989 | Germany | 194/350 |

*Primary Examiner*—Frank E. Werner
*Assistant Examiner*—Scott L. Lowe
*Attorney, Agent, or Firm*—Graham & James

[57] ABSTRACT

Various signals are exchanged between a coin acceptor section that identifies the authenticity of deposited coins and sorts out the on the basis of their denominations, and a change control section that receives the sorted-out coins and performs control to count the coins and to deliver the coins as a change. Such a signal exchange between the two sections is achieved through optical coupling between a light emitting diode and a photo transistor, without employing any electric contacts. Further, electric power supply from the change control section to the coin acceptor section is done through spring-biased probes without employing any electric connectors, or through inductive coupling without employing any electric contacts. Such arrangements can greatly facilitate attachment and detachment of the coin acceptor section to and from the change control section.

8 Claims, 6 Drawing Sheets

SIGNAL TRANSMITTING SYSTEM OF COIN ACCEPTOR SECTION 1

SIGNAL RECEIVING SYSTEM OF CHANGE CONTROL SECTION 2

COIN VALIDATOR WITH OPTICAL COUPLING

BACKGROUND OF THE INVENTION

The present invention generally relates to a coin changer for use in various kinds of coin handling apparatus such as automatic vending machines and money changing machines, and more particularly it relates to such a coin changer which transmits and receives a coin selection signal or other signal in the form of an optical signal and thereby can simplify the troublesome work necessary for coupling or decoupling signal transmitting and receiving systems of the coin changer.

Conventional coin changers generally comprises a coin acceptor section for identifying the authenticity and denomination of every coin deposited, and a change control section for receiving the identified coins separately for each denomination and controlling delivery or payment of change coins etc. In the some of the conventional coin changers, the coin acceptor section is separable from the change control section in order to facilitate or simplify cleaning of coin passages and coin identifying coils and also to provide enhanced efficiency of maintenance. Such type coin changers are known from, for example, U.S. Pat. No. 4,374,557.

In the known coin changers, the coin acceptor section has several functions such as: 1) a function to electronically identify the authenticity and denomination of every deposited coin by the use coin identifying coils etc. and then provide the change control section with a coin detection signal that is indicative of the identified denomination of the deposited coin; 2) a function to mechanically sort out every deposited coin on the basis of the identified denomination and direct the sorted-out coin toward predetermined one of coin receiving tubes that are provided for the respective denominations within the coin changer; and 3) a function to generate a signal indicative of the actuation of a return lever (cancellation signal) as well as a signal indicative of any abnormal condition of the coin acceptor section (acceptor-abnormal signal).

The change control section, on the other hand, has various functions such as: 1) a function to supply necessary electric power to the coin acceptor section; 2) a function to give the coin acceptor section a coin acceptance inhibiting signal; 3) a function to receive the coin detection signal from the coin acceptor section so as to count the total amount of the deposited coin(s) (i.e., deposited amount); 4) function to receive every coin sorted out by the coin acceptor section in predetermined one of the coin tubes or cash boxes provided for the respective denominations; 5) a function to deliver or pay out a necessary change coin(s) from the coin tube(s); 6) a function to return every deposited coin when the cancellation signal responsive to the actuation of the return lever has been received from the coin acceptor section; 7) a function to supply the main control section of the automatic vending machine with various kinds of signals such as a signal indicative of the deposited amount, the acceptor-abnormal signal, a signal indicative of the presence of an abnormal condition of the change control section itself, a signal indicative of the presence or absence of the change coins and other signals indicative of other conditions of the coin changer.

Therefore, with a coin changer which is capable of handling four denominations such as 500 Yen, 100 Yen, 50 Yen and 10 Yen, there are at least one kind of input signal (power supply input signal) and six kinds of output signals (four kinds of coin detection signals corresponding to four denominations, the cancellation signal and the acceptor-abnormal signal). Until now, transmission and reception, i.e., exchange of various signals between the coin acceptor section and the change control section has been done through electric wires, and thus it has been necessary to provide the same number of electric wires as the signals exchanged. To allow separable attachment between the two sections, arrangements are made such that the electric wires can be connected and disconnected via electric connectors.

However, because many electric wires are required for the signal exchange as mentioned above each connector must have many connection pins. In addition, because of an increasing demand for small-sized coin changers, each connector must be made small in size and hence must have many small connection pins densely mounted thereon. Such small-sized connectors present a problem that attachment/detachment of the coin acceptor section to/from the change control section is a very troublesome work.

Namely, with the coin acceptor section, the coin identifying coils and denomination sorting mechanism are components that perform the most important functions and occupy large space, leaving a minimum space for the connectors. Coupling/decoupling of the connectors in a narrow space involves extreme difficulty: for example, in the event an excessive force is applied to decouple the connectors provided in such a narrow space, the electric wire may be cut off or damaged. The use of the connectors may also present a problem that some connector is coupled with a wrong connector or inadvertently left uncoupled. The use of the connectors may present yet another problem that their contacts are stained, abraded or eroded, resulting in contact failure.

In addition, according to the disclosure of the above-mentioned U.S. Pat. No. 4,374,557, coin switches corresponding to the respective denominations are provided in the change control section, so as to reduce the number of signals exchanged between the coin acceptor section and the change control section so that the connector pins can be sufficiently large to facilitate decoupling of the connectors. However, because of the use of the electrical connectors, there still may arise the above-mentioned problem of contact failure due to abrasion or erosion. In addition, the provision of the coin switches in the change control section requires additional cost and space.

SUMMARY OF THE INVENTION

Therefore, it is an object of the present invention to provide a coin changer for an automatic vending machine or the like, which can solve all the above-mentioned problems of the prior art by making an exchange of various signals between a coin acceptor section and a change control section without using any electric connector.

A coin changer for an automatic vending machine or the like in accordance with the present invention comprises a coin acceptor section for identifying authenticity of a deposited coin and sorting out the coin by denomination, and a change control section for receiving the coin sorted out by the coin acceptor section and performing control to count the received coin and to deliver the received coin as a change when necessary, the coin acceptor section being removably attached to said change control section, the coin changer further comprising a light emitting element provided for the coin acceptor section, for transmitting, in optical signal, various signals output from the coin acceptor section, and a light receiving element provided for the change control section at a position corresponding to the light emitting element, for receiving the convert the signals optical signals to into electrical signals, whereby an exchange of the signals between the coin acceptor section and the change control section is performed optically.

The coin changer for an automatic vending machine or the like in accordance with the present invention further comprises a power supply output terminal provided at a predetermined position of the change control section, and a power supply input terminal comprising a spring-biased probe provided at a predetermined position of the coin acceptor section, the power supply input terminal being brought into abutting engagement with the power source output terminal when the coin acceptor section is attached to the change control section, to thereby allow electric power to be supplied from the change control section to the coin acceptor section.

The coin changer for an automatic vending machine of the like in accordance with present invention further comprises a power outputting primary coil provided at a predetermined position of the change control section, and a power inputting secondary coil provided at a predetermined position of the coin acceptor section such that the secondary coil corresponds in position to the primary coil when said coin acceptor is attached to the change control section, whereby inductive coupling between the primary coil and the secondary coil allows electric power to be supplied from the change control section to the coin acceptor section without employing any electric contact.

According to the present invention, because transmission of various signals between the coin acceptor section and the change control section is done optically without employing any electric contact or connection, no electric connector is required, attachment/detachment of the coin acceptor section to/from the change control section can be greatly simplified, and problems such as connection failure can be avoided. It should be apparent that, in order to transmit necessary signals from the change control section to the coin acceptor section, a light emitting element may be additionally provided for the change control section and a light receiving element may be additionally provided for the coin acceptor section.

Moreover, for electric power supply from the change control section to the coin acceptor, the use of spring-biased probes can eliminate conventional bite-type connectors which would require a troublesome work to be decoupled. Furthermore, by employing the spring-biased probes for the power supply input terminals of the coin acceptor section, the corresponding power supply output terminals of the change control section can be of a thin flat plate-like shape so that the power supply section does not provide a substantial projection which may become an unsafe obstacle.

Moreover, by employing inductive coupling as another arrangement for supplying electric power from the change control section to the coin acceptor section, it is allowed to provide a coin changer of a complete contactless and connectionless type.

Now, the preferred embodiment of the present invention will be described in detail with reference to the accompanying drawings.

DETAILED DESCRIPTION OF THE PREFERRED EMBODIMENT

Figure 1:
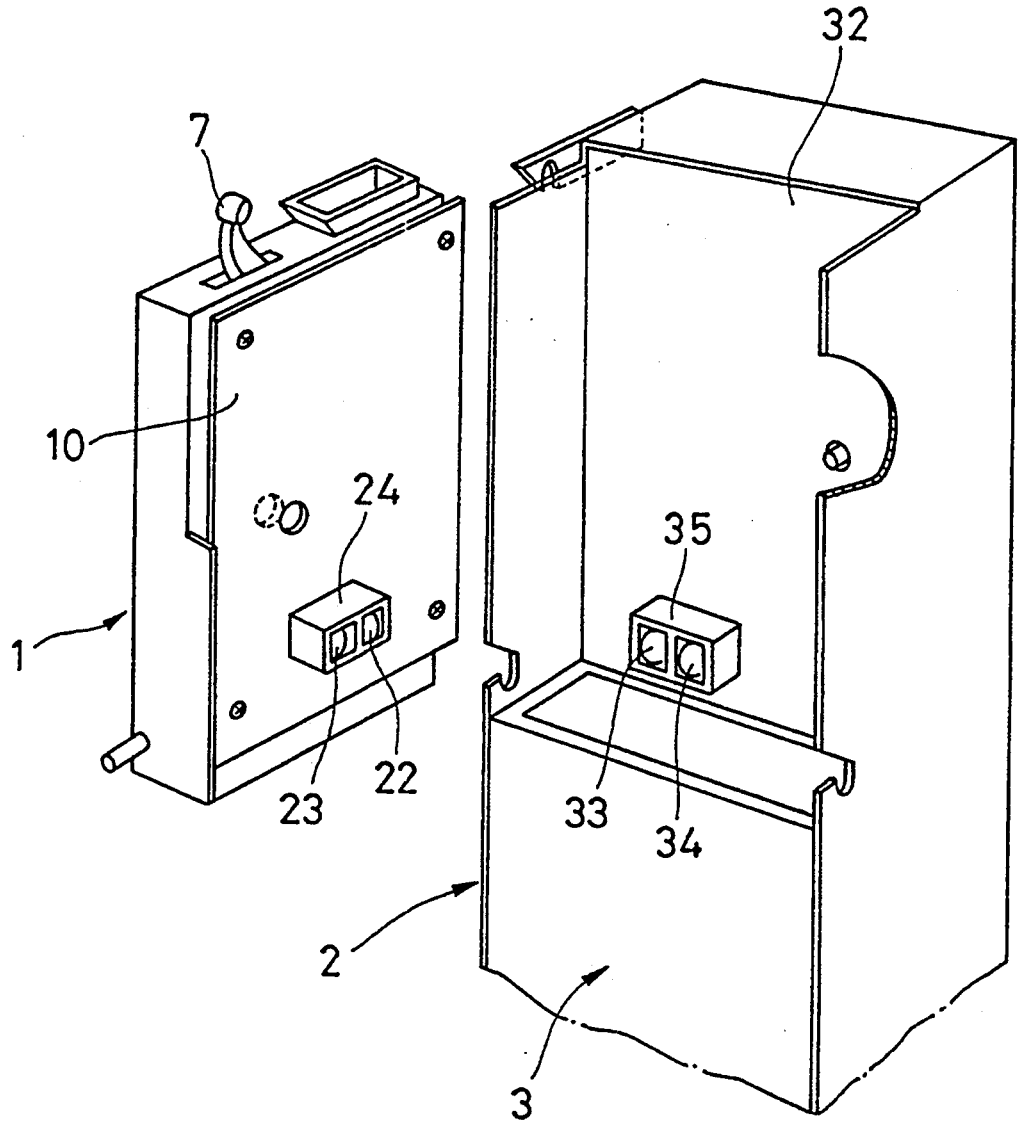
FIG. 1 is a perspective view of a coin changer of an automatic vending machine in accordance with an embodiment of the present invention, showing the coin changer with its coin acceptor section and change control section being separated or detached from each other.

As previously described in connection with the prior art, a coin acceptor section 1 shown in FIG. 1 has several functions such as: 1) a function to electronically identify the authenticity and denomination of every deposited coin by the use of coin identifying coils etc. and then provide the change control section with a coin detection signal that is indicative of the identified denomination of the deposited coin; 2) a function to mechanically sort out every deposited coin on the basis of the identified denomination and direct the sorted-out coin toward predetermined one of coin receiving tubes that are provided for the respective denominations within the coin changer; and 3) a function to generate a signal indicative of the actuation of a return lever (cancellation signal) as well as a signal indicative of any abnormal condition of the coin acceptor section (acceptor-abnormal signal).

The change control section, on the other hand, has various functions such as: 1) a function to supply necessary electric power to the coin acceptor section: 2) a function to give the coin acceptor section a coin acceptance inhibiting signal; 3) a function to receive the coin detection signal from the coin acceptor section so as to count the total amount of the deposited coin(s) (i.e., deposited amount); 4) a function to receive every coin sorted out by the coin acceptor section in predetermined one of the coin tubes or cash boxes provided for the respective denominations; 5) a function to deliver or pay out a necessary change coin (s) from the coin tube(s): 6) a function to return every deposited coin when the cancellation signal responsive to the actuation of the return lever has been received from the coin acceptor section; 7) a function to supply an unillustrated main control section of the automatic vending machine with various kinds of signals such as a signal indicative of the counted deposited amount, she acceptor-abnormal signal, a signal indicative of the presence of an abnormal condition of the change control section itself, a signal indicative of the presence or absence of the change coins and other signals indicative of other conditions of the coin changer.

On the backside of a print circuit board 10 of the coin acceptor section 1, there are mounted a light emitting diode 22 which works as a light emitting element and a photo transistor 23 which works as a light receiving element. At corresponding positions on a wall 32 of the change control section 2, there are mounted a photo transistor 33 which works as a light receiving element and a light emitting diode 34 which works as a light emitting element. The photo transistor 33 of the change control section 2 and the light emitting diode 22 of the coin acceptor section 1 are directly opposed to each other in such a manner that the photo transistor 33 is positioned along the optical axis of light emitted from the light emitting diode 22. Likewise, the photo transistor 23 of the coin acceptor section 1 and the light emitting diode 34 the change control section 2 are directly opposed to each other in such a manner that the photo transistor 23 is positioned along the optical axis of light emitted from the light emitting diode 34. The light emitted from the light emitting diode 22 on the print circuit board 10 is directed to and received by the photo transistor 33, which in turn converts the received light into an electrical signal. Similarly, the light emitted from the light emitting diode 34 on the wall 32 is directed to and received by the photo transistor 23, which in turn converts the received light into an electrical signal.

The print circuit board 10 is also provided with a gobo or light blocking plate 24 which surrounds the light emitting diode 22 and photo transistor 23. The blocking plate 24 guarantees that the light emitted from the light emitting diode 22 will never be leaked out to the adjoining photo transistor 23 and that the light directed to the photo transistor 23 will never be leaked out to the light emitting diode 22. Similarly, the wall 32 of the change control section 2 is provided with a gobo or light blocking plate 35 which surrounds the light emitting diode 34 and photo transistor 33. The light blocking plate 35 guarantees that the light emitted from the light emitting diode 34 will never be leaked out to the adjoining photo transistor 33 and that the light directed to the photo transistor 33 will never be leaked out to the light emitting diode 34.

Figure 2:
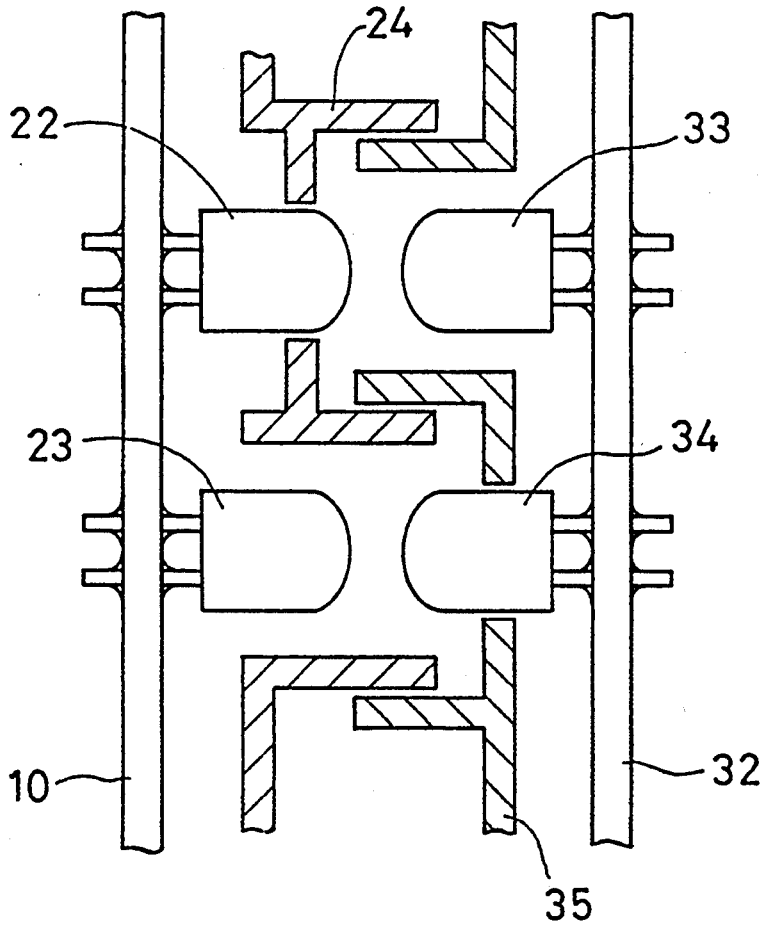
FIG. 2 is a top plan view, partly broken away, of a connection between the coin acceptor section and the change control section, showing, by way of example, the arrangement of a connection between signal transmitting and receiving systems of the two sections.

As shown in FIG. 2, the portion of the light blocking plate 24 which surrounds the light emitting diode 22 has a size greater than the portion surrounding the photo transistor 23. The portion of the light blocking plate 35 which surrounds the photo transistor 33 has a size smaller than the portion surrounding the light emitting diode 34. When the coin changer is properly assembled so that the coin acceptor section 1 and the change control section 2 are operatively connected with each other, the portion of the light blocking plate 24 surrounding the photo transistor 23 enters the portion of the light blocking plate 35 surrounding the light emitting diode 34, and the portion of the light blocking plate 35 surrounding the photo transistor 34 enters the portion of the light blocking plate 24 surrounding the light emitting diode 22. With this arrangement, a high light blocking rate can be obtained.

Figure 3:
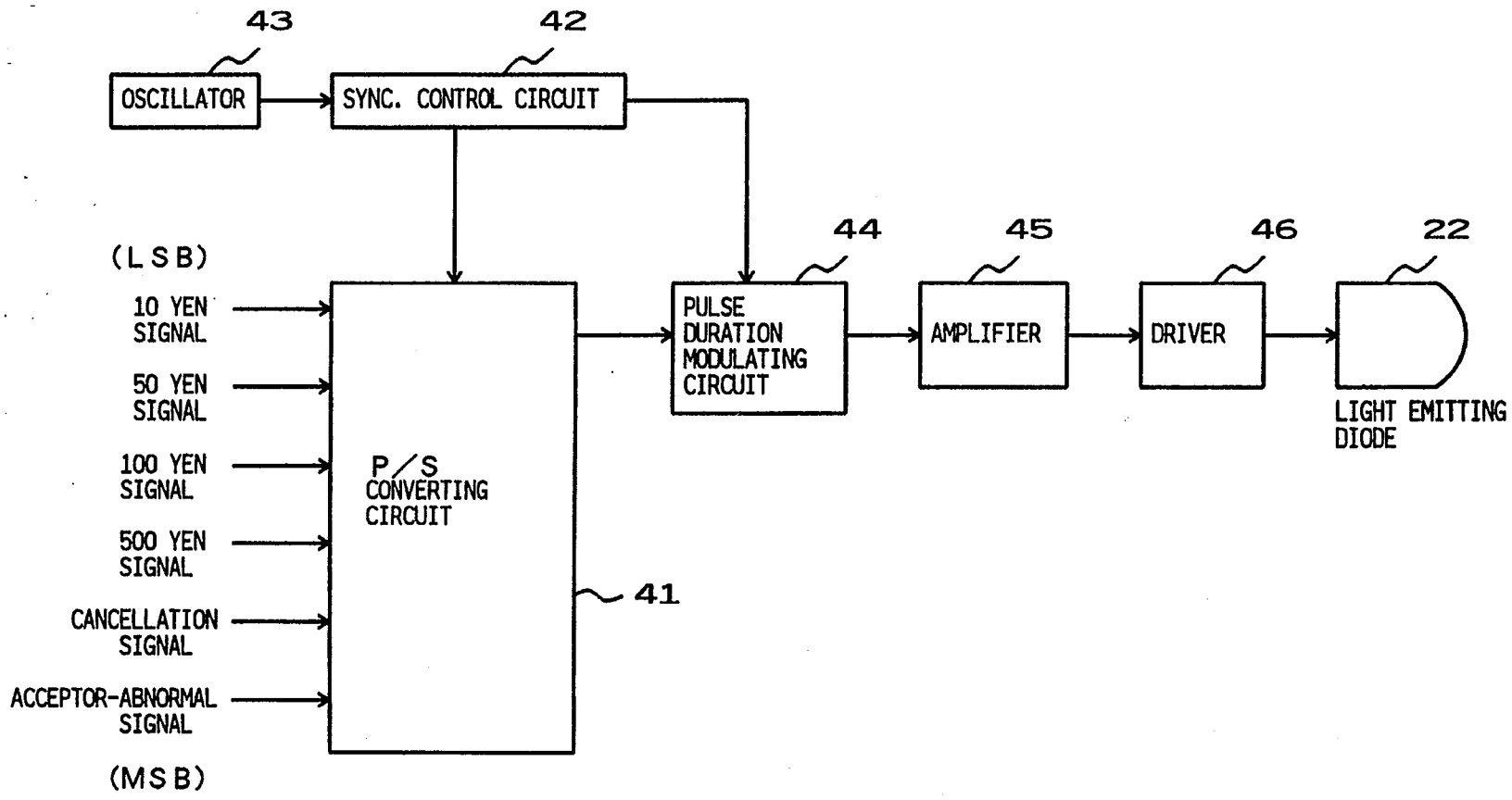
FIG. 3 is a block diagram illustrating an example circuit structure of the signal transmitting system of the coin acceptor section.

FIG. 3 is a block diagram illustrating an example of circuitry employed for a signal transmitting system of the coin acceptor section 1. In the coin acceptor section 1, a 10 Yen coin detection signal, 50 Yen coin detection signal, 100 Yen coin detection signal, 500 Yen coin detection signal, the cancellation signal, the acceptor-abnormal signal etc. are generated depending on the current coin deposit state and the current operation state of the return lever 7, and the thus-generated signals are input to a parallel-to-serial converting circuit 41.

The parallel-to-serial converting circuit 41 receives predetermined timing data that are generated by a synchronization control circuit 42 on the basis of clock pulses generated from an oscillator 43. In accordance with the timing data, the circuit 41 converts the parallelly input signals into serial signals. The converting circuit 41 transfers the serial signals to a pulse duration modulating circuit 44, along with synchronization signals each indicative of one frame of the serial signals. The pulse duration modulating circuit 44 applies a pulse duration modulation process to the converted serial signals, i.e., modulating a predetermined carrier wave with the serial signals. The resultant pulse-duration modulated signals are given to an amplifier 45.

The amplifier 45 amplifies the pulse-duration modulated signals and then transfers the signals to a driver 46. In response to the signals, the driver 56 outputs drive signals to the light emitting diode 22. The light emitting diode 22 generates optical signals corresponding to the respective states of the signals, and the optical signals are directed to the corresponding photo transistor 33.

Figure 4:
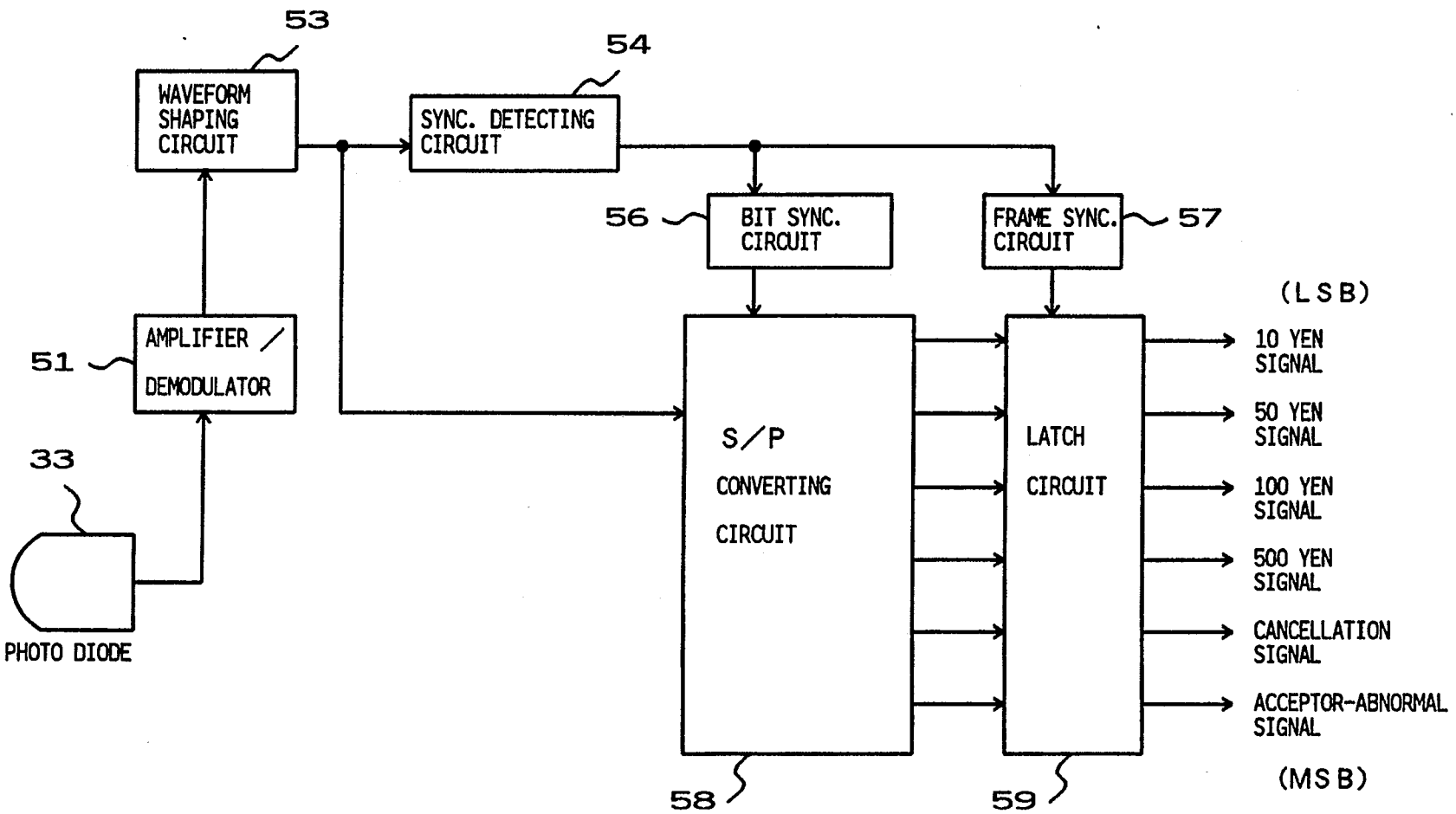
FIG. 4 is a block diagram illustrating an example circuit structure of the signal receiving system of the change control section.

FIG. 4 is a block diagram illustrating an example of circuitry employed for a signal receiving system of the change control section 2. The photo transistor 33 receives the optical signals emitted from the light emitting diode 22 to converts the signals into electrical signals. The electrical signals are then passed on to an amplifier/dempdulator 51. The amplifier/demodulator 51 amplifies and demodulates the electrical signals i.e., the above-mentioned 10 Yen coin detection signal, 50 Yen coin detection signal, 100 Yen coin detection signal, 500 Yen coin detection signal, cancellation signal, acceptor-abnormal signal etc. and transfers these signals to a waveform shaping circuit 53. The waveform shaping circuit 53 reshapes the respective waveforms of the amplified signals and sends the waveform-reshaped signals to synchronization detecting circuit 54.

The synchronization detecting circuit 54 detects the synchronization signals on the basis of the serial input signals so as to count timings and provides synchronization signals to a bit synchronizing circuit 56 and a frame synchronizing circuit 57. On the basis of the synchronization signals, the bit synchronizing circuit 56 prepares bit synchronization signals to be used for converting the respective signals again into parallel signals and passes the synchronization signals to a serial-to-parallel converting circuit 58. The frame synchronizing circuit 57 determines the length of one frame of the signals and informs the determined length to a latch circuit 59. The serial-to-parallel converting circuit 58 sequentially receives the serial signals in response to the bit synchronization signals given from the bit synchronizing circuit 56, so as to convert the above-mentioned 10 Yen coin detection signal, 50 Yen coin detection signal, 100 Yen coin detection signal, 500 Yen coin detection signal, cancellation signal, acceptor-abnormal signal etc. into parallel form. The thus-converted signals are then transferred to a latch circuit 59.

The latch circuit 59 receives the parallel signals from the serial-to-parallel converting circuit 58 to latch the signals therein in response to the output signals from the frame synchronizing circuit 57. In this way, the respective signals provided from the coin acceptor section 1 are converted into parallel form again and are provided to, for example, an operation circuit of a CPU (not shown).

Figure 5:
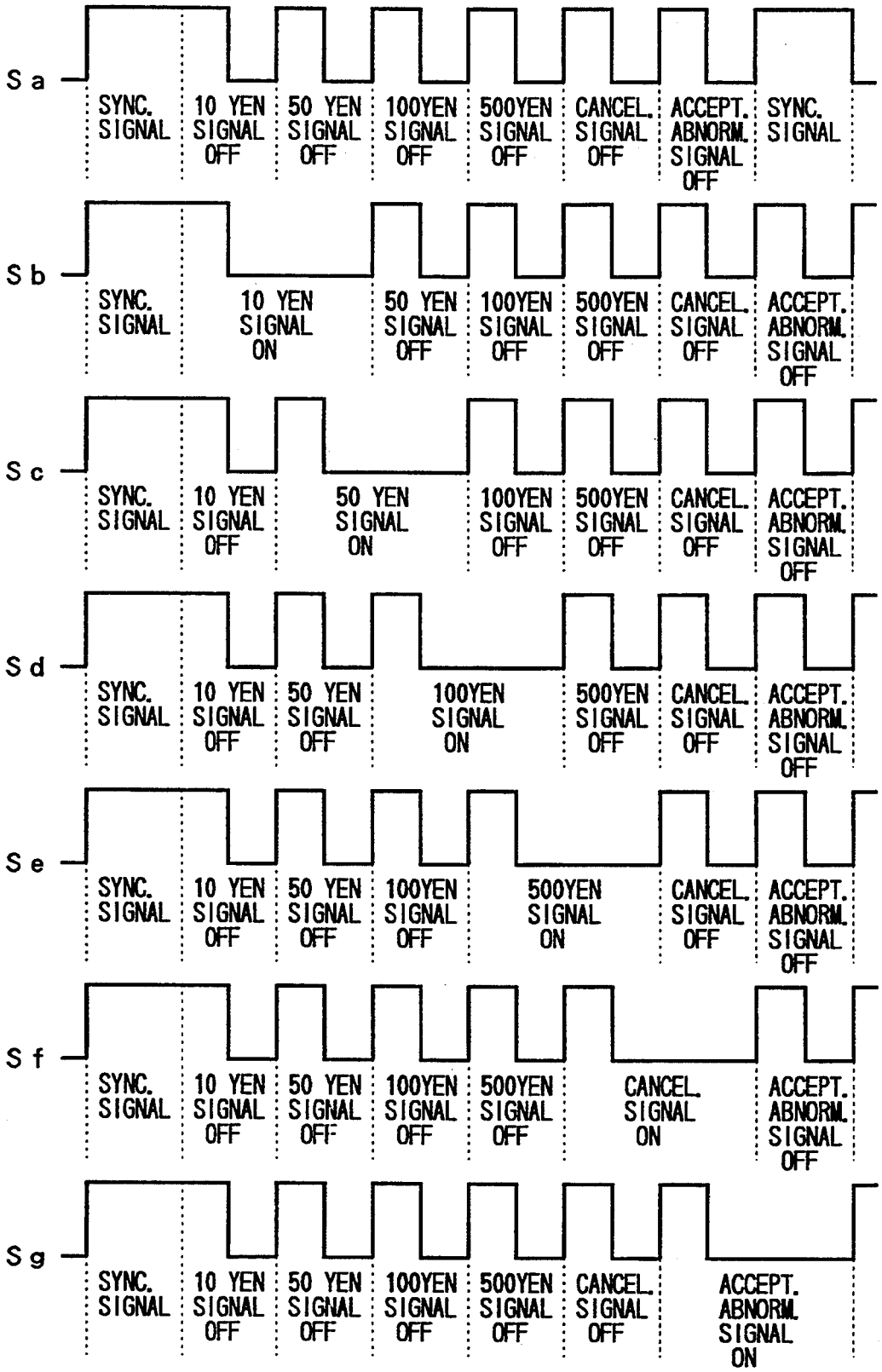
FIG. 5 is a diagram explaining specific examples of waveforms of serial optical signals which are provided from the coin acceptor section to the change control section.

FIG. 5 is a diagram illustrating, by way of example, various waveforms of the signals provided from the coin acceptor section 1 to the change control section 2. In FIG. 5, signal waveform Sa is obtained when no coin is deposited, the return lever 7 is not actuated and there is no abnormal condition in the coin acceptor section. Each of the 10 Yen coin detection signal, 50 Yen coin detection signal, 100 Yen coin detection signal, 500 Yen coin detection signal, the cancellation signal and the acceptor-abnormal signal is OFF and has a waveform corresponding one cycle of the clock pulse.

Signal waveform Sb is obtained when only a 10 YEN coin has been deposited. Thus, only the 10 YEN coin detection signal is ON and represents a prolonged low level state corresponding to one cycle and a half of the clock pulse. Signal waveform Sc is obtained when only a 50 YEN coin has been deposited. Thus, only the 50 YEN coin detection signal is ON and represents a prolonged low level state corresponding to one cycle and a half of the clock pulse. Signal waveform Sd is obtained when only a 100 YEN coin has been deposited. Thus, only the 100 YEN detection coin signal is ON and represents a prolonged low level state corresponding to one cycle and a half of the clock pulse. Signal waveform Se is obtained when only a 500 YEN coin has been deposited. Thus, only the 500 YEN coin detection signal is ON and represents a prolonged low level state corresponding to one cycle and a half of the clock pulse. Signal waveform Sf is obtained when only the return lever 7 has been actuated. Thus, only the cancellation signal is ON and represents a prolonged low level state corresponding to one cycle and a half of the clock pulse. Signal waveform Sg is obtained when there has occurred an abnormal condition in the coin acceptor section 1. Thus, only the acceptor-abnormal signal is ON and represents a prolonged low state corresponding to one cycle and a half of the clock pulse.

It may be assumed that the photo transistor 23 of the coin acceptor section 1 is connected with circuitry similar to the above-mentioned receiving system circuitry of the change control section 2 and also that the light emitting diode 34 of the change control section 2 is connected with the above-mentioned transmitting system circuitry of the coin acceptor section 1. Accordingly, no detail description will be made herein. Among various signals provided from the change control section 2 to the coin acceptor section 1 is an acceptance inhibition signal indicative of inhibition of coin acceptance. Although not specifically shown, a reject pin is caused to work in response to such an acceptance inhibition signal. If there is no specific signal to be given from the change control section 2 to the coin acceptor section 1, it is of course possible to omit the photo transistor 23 of the coin acceptor section 1 and the light emitting diode 34 of the change control section 2.

Because the respective signals are transmitted by optical means as described above, the signal transmission channels between the change control section 2 and the coin acceptor section 1 can be contactless and connectionless channels which will never require electric wires and connectors. However, since electric power supply from the change control section 2 to the coin acceptor section can not be done via such optical means, the following feature is provided in the preferred embodiment.

Figure 6:
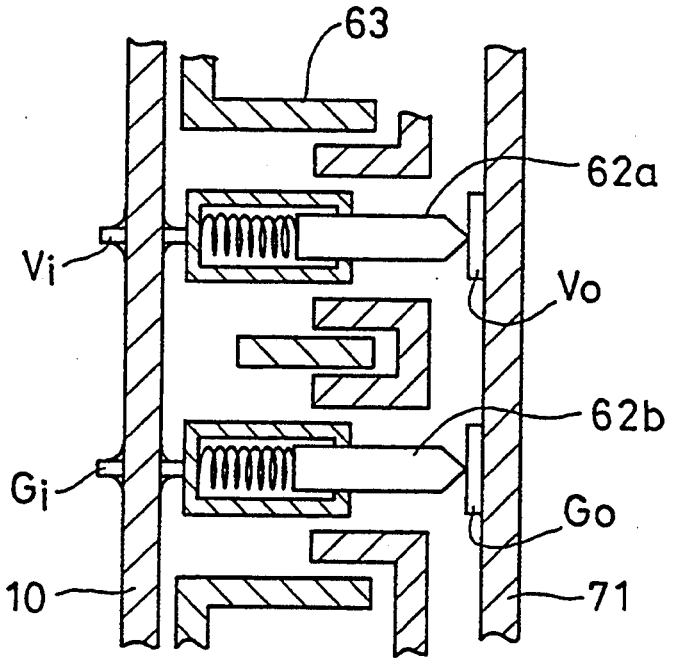
FIG. 6 is a top plan view, partly broken away, of a connection between the coin acceptor section and the change control section, showing an example arrangement for supplying electric power from the change control section to the coin acceptor section.

FIG. 6 is a fragmentary top plan view, showing the arrangement of a power supply section of the embodiment. In this example, power supply output terminals Vo, Go are arranged at predetermined positions on a print circuit board 71 of the change control section 2, and the coin acceptor section 1 has power supply input terminals comprising spring probes (spring-biased probes) 62*a*, 62*b*. The spring probes 62*a*, 62*b* are provided at predetermined positions such that when the coin acceptor section 1 is properly attached to the change control section 2, the spring probes 62*a*, 62*b* are brought into abutting engagement with the power supply output terminals Vo, Go and thereby allow electric power to be supplied from the change control section 2 to the coin acceptor section 1.

More specifically, the spring probes 62*a*, 62*b*, which are provided at the predetermined positions on the print circuit board 10 of the coin acceptor section 1 and are surrounded by a protecting case 63, are connected to the power supply input terminals Vi, Gi of the print circuit board 10. When the coin acceptor section 1 is properly coupled with the change control section 2, the tips of the spring probes 62*a*, 62*b* are pushed by respective springs to connect to the power supply output terminals Vo, Go of the print circuit board 71 and thereby allow electric power to be supplied to the coin acceptor section 21.

Figure 7:
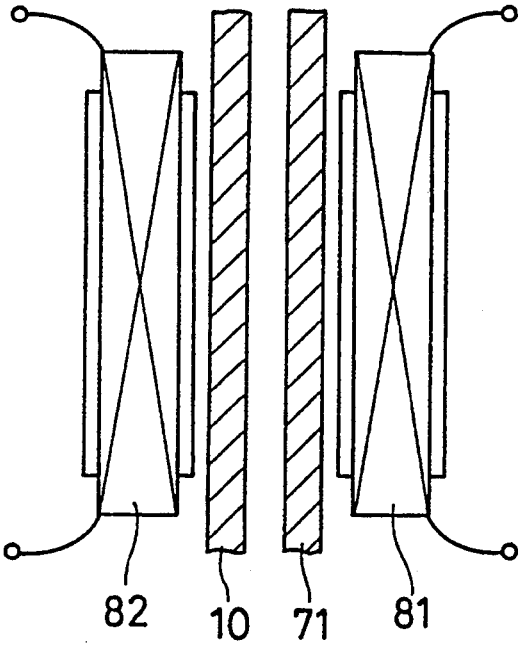
FIG. 7 is a top plan view, partly broken away, of a connection between the coin acceptor section and the change control section, showing another example of the arrangement for supplying electric power from the change control section to the coin acceptor section.

FIG. 7 is a fragmentary top plan view, showing a modified arrangement of the power supply section. In this example, a primary coil 81 for power supply output is provided at a predetermined position on the print circuit board 71 of the change control section 3, while a secondary coil 81 for inputting power is provided at a predetermined position on the print circuit board 10 of the coin acceptor section 2. The inductive coupling between the primary coil 81 and the secondary 82 permits electric power to be supplied from the change control section 2 to the coin acceptor section 1 without employing electric contacts.

According to the present invention as has so far been described, because transmission of various signals between the coin acceptor section and the change control section is done optically without employing electric contacts or connections, there are achieved superior advantages that no electric connectors are required, attachment/detachment of the coin acceptor section to/from the change control section can be greatly simplified and problems such as connection failure can be avoided.

Moreover, for electric power supply from the change control section to the coin acceptor, the use of spring-biased probes can eliminate bite-type connectors which would require a troublesome work to be detached. Furthermore, by employing the spring-biased probes for the power supply input terminals of the coin acceptor section, the power supply output terminals of the change control section can be of a thin flat plate-like shape so that the power supply section does not provide a substantial projection.

Moreover, by employing inductive coupling as another arrangement for power supply from the change control section to the coin acceptor section, it is allowed to provide a coin changer of a complete contactless and connectionless type.

What is claimed is:

1. A coin changer comprising coin acceptor means for identifying authenticity of a deposited coin and sorting out the coin by denomination, and change control means for receiving the coin sorted out by said coin acceptor means and performing control to count the received coin and to deliver the received coin as a change when necessary, said coin acceptor means being removably attached to said change control means, said coin changer further comprising:

a first light emitting element provided for said coin acceptor means, for transmitting first optical signals from said coin acceptor means; and a first light receiving element provided for said change control means for receiving the first optical signals to convert the first optical signals into first electrical signals.

2. A coin changer as defined in claim 1 which further comprises:

a power supply output terminal provided at a predetermined position of said change control means; and a power supply input terminal comprising a spring-biased probe provided at a predetermined position of said coin acceptor means, said power supply input terminal being brought into abutting engagement with said power supply output terminal when said coin acceptor means is attached to said change control means, to thereby allow electric power to be supplied from said change control means to said coin acceptor means.

3. A coin changer as defined in claim 1 which further comprises:

a power outputting primary coil provided at a predetermined position of said change control means: and a power inputting secondary coil provided at a predetermined position of said coin acceptor means such that said secondary coil corresponds in position to said primary coil when said coin acceptor means is attached to said change control means, wherein inductive coupling between said primary coil and said secondary coil allows electric power to be supplied from said change control means to said coin acceptor means without employing any electric contact.

4. A coin changer as defined in claim i which further comprises:

first light blocking wall provided around a periphery of said first light emitting element; and a second light blocking wall provided around a periphery of said first light receiving element, and wherein, when said coin acceptor means is attached to said change control means, one of said first and second light blocking walls substantially fits into the other so that a double wall, defined by superposition of said walls, blocks light from escaping to outside of the periphery of the superpositioned walls.

5. A coin changer as defined in claim 1 which further comprises:

second light emitting element provided for said change control means, for transmitting second optical signals from said change control means to said coin acceptor means; and a second light receiving element provided for said coin acceptor means at a position corresponding to said second light emitting element, for receiving the second optical signals to convert the second optical signals into second electrical signals.

6. A coin changer as defined in claim 5 which further comprises:

first and second light blocking walls provided around peripheries of said first and second light emitting elements, respectively;

third and fourth light blocking walls provided around peripheries of said first and second light receiving elements, respectively; and wherein, when said coin acceptor means is attached to said change control means, one of said first and third light blocking walls substantially fits into the other of said first and third light blocking walls, and one of said second and fourth light locking walls substantially fits into the other of said second and fourth light blocking walls.

7. A coin changer as defined in claim 1 wherein said first optical signals are in serial form and indicate a presence of individual coins in said coin acceptor means.

8. A coin changer as defined in claim 7 wherein said first optical signals are sequential optical pulses corresponding to the denominations of the individual coins, such that an optical pulse corresponding to a particular denomination of a coin is different in duration from an optical pulse corresponding to any other denomination of coin.

* * * * *